US005689753A

United States Patent [19]

Twist

[11] Patent Number: 5,689,753

[45] Date of Patent: Nov. 18, 1997

[54] METHOD OF PHOTOGRAPHIC PROCESSING WITH SOLUTION REPLENISHMENT

[75] Inventor: Peter Jeffery Twist, Missenden, England

[73] Assignee: Eastman Kodak Company, Rochester, N.Y.

[21] Appl. No.: 667,200

[22] Filed: Jun. 20, 1996

[30] Foreign Application Priority Data

Jun. 22, 1995 [GB] United Kingdom ..... 9512700

[51] Int. Cl.[6] ..... G03D 3/02

[52] U.S. Cl. ..... 396/626; 430/376

[58] Field of Search ..... 396/626, 630; 430/398–400, 376, 567, 573

[56] References Cited

U.S. PATENT DOCUMENTS

| | | | |
|---|---|---|---|
| 2,605,684 | 8/1952 | Nagels et al. | 396/607 |
| 3,674,490 | 7/1972 | Matejec et al. . | |
| 3,943,541 | 3/1976 | Hirafuji | 396/606 |
| 4,613,223 | 9/1986 | Cherry et al. | 396/622 |
| 5,179,404 | 1/1993 | Bartell et al. | 396/617 |
| 5,252,451 | 10/1993 | Bell | 430/567 |
| 5,270,762 | 12/1993 | Rosenburgh et al. | 396/632 |
| 5,294,956 | 3/1994 | Earle | 396/620 |
| 5,298,932 | 3/1994 | Twist | 396/632 |
| 5,324,624 | 6/1994 | Twist | 430/399 |
| 5,387,499 | 2/1995 | Earle et al. | 396/626 |

FOREIGN PATENT DOCUMENTS

| | | | |
|---|---|---|---|
| 0 530 889 | 3/1993 | European Pat. Off. | 430/348 |
| 0 559 025 | 9/1993 | European Pat. Off. | 396/626 |
| 0 559 026 | 9/1993 | European Pat. Off. | 396/626 |
| 0 559 027 | 9/1993 | European Pat. Off. | 396/626 |
| 1 399 481 | 7/1975 | United Kingdom . | |
| 1 403 418 | 8/1975 | United Kingdom | 430/573 |
| 1 522 104 | 8/1978 | United Kingdom | 396/634 |
| 1 560 572 | 2/1980 | United Kingdom | 430/376 |
| 1 582 219 | 1/1981 | United Kingdom . | |
| 91/12567 | 8/1991 | WIPO | 396/626 |
| 91/19226 | 12/1991 | WIPO . | |
| 92/07301 | 4/1992 | WIPO . | |
| 92/07302 | 4/1992 | WIPO . | |
| 92/09932 | 6/1992 | WIPO . | |
| 92/10790 | 6/1992 | WIPO . | |
| 92/17370 | 10/1992 | WIPO . | |
| 92/17819 | 10/1992 | WIPO . | |
| 93/00612 | 1/1993 | WIPO . | |
| 93/04404 | 3/1993 | WIPO . | |
| 93/11463 | 6/1993 | WIPO . | |
| 93/11464 | 6/1993 | WIPO . | |

OTHER PUBLICATIONS

RD, Dec. 1989, No. 308119, pp. 993–1015, "Photographic Silver Halide Emulsions, Preparations, Addenda, Processing and Systems".

*Primary Examiner*—D. Rutledge
*Attorney, Agent, or Firm*—Frank Pincelli

[57] ABSTRACT

A method of redox amplification processing of a photographic color material in which the image-forming step takes place in a developer-amplifier solution containing both a photographic color developing agent and an oxidant contained in a processing tank of comparatively small volume (the processing tank). A developer-amplifier replenisher solution which is stable over an idle period of 48 hours, is provided from a tank of comparatively large volume (the reservoir) holding sufficient for replenishment over a predetermined extended period of time at a rate which is greater than 160 ml/m$^2$ of material processed. The overflow from the processing tank is returned to the reservoir where additions are made in a predetermined manner from water and/or one or more of four solutions comprising color developing agent concentrate, oxidant concentrate, buffer concentrate and anti-oxidant concentrate.

9 Claims, 2 Drawing Sheets

METHOD OF PHOTOGRAPHIC PROCESSING WITH SOLUTION REPLENISHMENT

FIELD OF THE INVENTION

This invention relates to a method of photographic processing and in particular to a method of redox amplification in which the developer-amplifier is replenished.

BACKGROUND OF THE INVENTION

Redox amplification processes have been described, for example in British Specification Nos. 1,268,126, 1,399,481, 1,403,418 and 1,560,572. In such processes color materials are developed to produce a silver image (which may contain only small amounts of silver) and then treated with a redox amplifying solution (or a combined developer-amplifier) to form a dye image.

The developer-amplifier solution contains a color developing agent and an oxidising agent which will oxidise the color developing agent in the presence of the silver image which acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidising agents include peroxy compounds including hydrogen peroxide and compounds which provide hydrogen peroxide, e.g., addition compounds of hydrogen peroxide; cobalt (III) complexes including cobalt hexammine complexes; and periodates. Mixtures of such compounds can also be used.

The stability of developer/amplifiers has always been a critical factor in these processes. Since they contain both a reducing agent and an oxidising agent, spontaneous reaction thereof can occur leading to loss of activity of the solution.

Redox (RX) developer/amplifiers usually need to be replenished by two solutions which are passed separately into the processing tank or mixed just before entering the tank. These solutions are:

1. a solution containing all the developer/amplifier components except hydrogen peroxide or other RX oxidant.
2. a solution of hydrogen peroxide or other RX oxidant.

Conventional replenishers consist of a single dev/amp-replenisher which is stable and can be used over a period of days or weeks. The reason why two replenisher solutions are required for RX developer/amplifiers is the relative instability of a "made-up" replenisher which has hydrogen peroxide mixed in. This is particularly true for the "made-up" replenisher as compared with the developer/amplifier itself because replenishers need to be more concentrated than the developer/amplifier in order to make up for chemical consumption as the photographic material is processed. This means that the color developing agent, the anti-oxidant and the hydrogen peroxide are more concentrated and so react together at a faster rate thus degrading the made-up replenisher. The replenisher thus becomes increasingly unable to maintain the working developer/amplifier at aim composition.

The Quasi-Flooded-Replenishment method or QFR is a replenishment system which has been applied to non-RX processing (European Patent 0 530 889 and U.S. Pat. No. 5,298,932) and uses a high throughput of replenisher from a reservoir of about 10× the normal rate in order to provide consistency in the working dev/amp. In this system the overflow from the dev/amp is passed back into a treatment tank where it is then made back up to replenisher concentration by means of addition of developer concentrates before returning it to the reservoir. For the standard RA4 process, these concentrates can be those used to make up replenisher from a standard kit having three parts.

The improvement in the stability of RX developer/amplifiers outlined in our copending application numbers EP 9321648.9 (Docket 67315), 94203006.5 (Docket 64747) and GB 9419978.3 (Docket 69891) now makes it possible to apply the principles of quasi-flooded replenishment to redox developer/amplifiers (dev/amp) in a simple manner. We have now surprisingly found that using the quasi-flooded replenishment method in redox amplification processes leads to considerable advantages not apparent from the former quasi-flooded non-RX replenishment scheme referred to above.

PROBLEM TO BE SOLVED BY THE INVENTION

The problem solved by the present invention is how to improve the replenishment of developer/amplifier solutions used in redox amplification processes.

SUMMARY OF THE INVENTION

According to the present invention there is provided a method of redox amplification processing of a photographic color material in which the image-forming step takes place in a developer-amplifier solution containing both a photographic color developing agent and an oxidant contained in a processing tank of comparatively small volume (the processing tank), in which a developer-amplifier replenisher solution which is stable over an idle period of 48 hours, is provided from a tank of comparatively large volume (the reservoir) holding sufficient for replenishment over a predetermined extended period of time at a rate which is greater than 160 ml/m$^2$ of material processed, the overflow from the processing-tank is returned to the reservoir where additions are made in a predetermined manner from water and/or one or more of four solutions comprising color developing agent concentrate, oxidant concentrate, buffer concentrate and anti-oxidant concentrate.

ADVANTAGEOUS EFFECT OF THE INVENTION

1. A low volume tank is needed for RX developer/amplifiers in order to allow rapid tank turnover of relatively unstable solutions. This system however has low chemical inertia and so can cause variability. The QFR system overcomes this and also solution level variability.

2. Time dependent replenishment(TDR) can be used to maintain a QFR replenisher or a "normal" made-up RX replenisher. However the amount of TDR in QFR is about half that for the "normal" made-up RX replenisher (see chemical loss rates in Table 3). The increase in components which react together, that is, CD3, HAS and peroxide, cause double the chemical loss rate. This would not be the case with non-RX development where both the QFR replenisher and the "normal" replenisher are stable since they do not contain hydrogen peroxide and also the higher CD3 level in the "normal" replenisher is protected against increased aerial oxidation by a higher level of anti-oxidant. This shows that QFR for RX is cheaper and more environmental than "normal" made-up RX replenisher.

3. The direct replenishment of the small volume tank with concentrates A, B, C and D is possible but adding small volumes of concentrates to a small tank with low chemical inertia can lead to variability. Since such tanks are very advantageous for RX for rapid turnover reasons they need to be used and so use of direct replenishment could lead to variability. QFR overcomes this problem and allows the use of replenishment by concentrates in an accurate manner.

4. QFR has a similar effect on tank-turnover rate as does reducing the dev/amp tank volume. Low volume thin tanks (LVTTs) are very low volume, for example, 1.8 liters compared with the normal 22 liters in the KODAK™ Model 52R processor. This is a reduction in volume of about 12×. Exactly the same effect can be obtained by using QFR at 12× the standard replenishment rate but with a conventional size dev/amp tank of 22 liters.

5. The system can use the standard replenisher tank or a modified tank in the same space and so does not necessarily increase the size of the processor.

6. A control strip will guarantee the integrity of the replenisher at the predetermined time which could, for example, be the time taken to process about 20 orders. This is not possible with low volume tanks run in the conventional mode because there is no recirculation of the processing solution.

7. The system can be run at any utilisation level without "crashing" because the replenisher is monitored and its composition can be adjusted every day or every time it is used.

8. The color developer content of the replenisher fed to the low volume processing tank is much more dilute than a conventional one which means much less chance of precipitation and discoloration.

BRIEF DESCRIPTION OF THE DRAWINGS

In the accompanying drawings

DETAILED DESCRIPTION OF THE INVENTION

Figure 1:
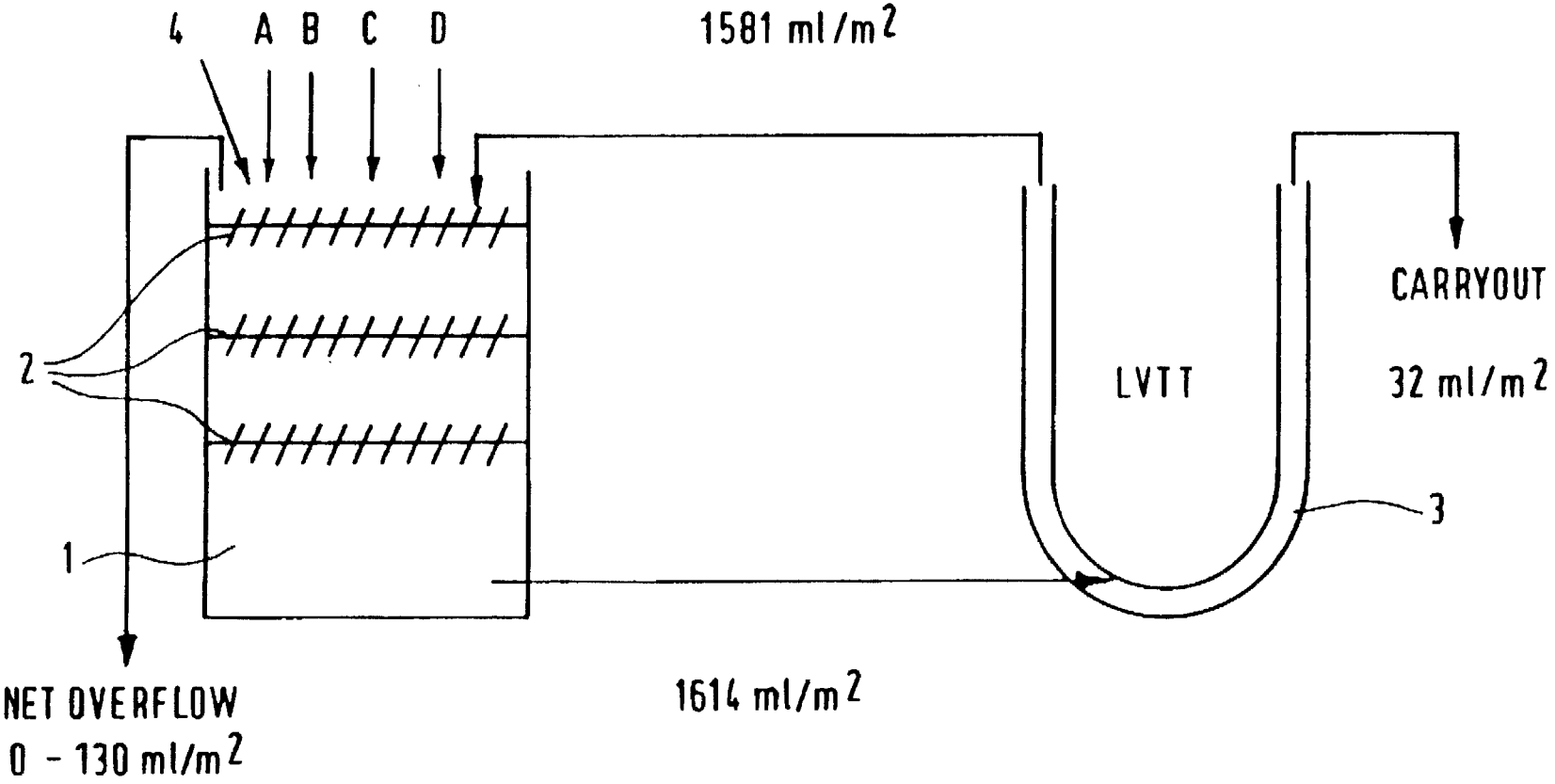
FIGS. 1 and 2 are diagrammatic representations of two embodiments of the replenishment methods used in the present invention.

In one embodiment the replenisher solution contains a compound having a hydrophobic hydrocarbon group and a group which adsorbs to silver or stainless steel solubilised if necesssary with a non-ionic water-soluble surfactant as described in our GB 9419978.3 referred to above. Such compounds may be primary, secondary or tertiary long chain alkylamines, long chain alkyl quaternary ammonium salts, long chain alkyl heterocyclic ammonium salts, long chain alkyl aminocarboxylic acids, long chain alkyl aminosulphonic acids, long chain alkyl diamines, long chain alkyl branched alkyldiamines, long chain alkyl thiols, long chain alkyl thiocarboxylic acids, long chain alkyl thiosulphonic acids, long chain alkyl-substituted nitrogen-containing heterocyclic or mercaptoheterocyclic compounds in which the long chain alkyl group contains 6–20 carbon atoms.

In another embodiment the replenisher contains hydroxylamine or a salt thereof as described in our copending EP 94203006.5 referred to above.

The color developing agent may be one of the following:

4-amino-3-methyl-N,N-diethylaniline hydrochloride, 4-amino-3-methyl-N-ethyl-N-β-(methanesulphonamido)-ethylaniline sulphate hydrate, 4-amino-3-methyl-N-ethyl-N-β-hydroxyethylaniline sulphate, 4-amino-3-β-(methanesulphonamido)ethyl-N,N-diethylaniline hydrochloride and 4-amino-N-ethyl-N-(2-methoxy-ethyl)-m-toluidine di-p-toluene sulphonate.

The redox oxidant is preferably hydrogen peroxide or a compounds which can release hydrogen peroxide.

The preferred pH of the replenisher is in the range 10.5 to 12, preferably 11 to 12, more preferably 11 to 11.7.

Developer/amplifiers which can be stable over 48 hours are described and claimed in our British Applications 9321648.9, 9321656.2 and 9419978.3. In the present specification and claims the term "stable over an idle period of 48 hours" means that the sensitometric results obtained before and after are essentially unchanged over this time period.

The rate at which the replenisher is fed to the processing tank (the flooded replenishment rate) can, for example, be 10× the normal replenishment rate of 160 ml/m$^2$. The overflow is preferably passed back into the top of the replenisher reservoir with restricted mixing. The replenisher or separate tank is then itself replenished by means of concentrates after the predetermined period of time. The flooded replenishment rate used in the present invention is preferably from 320 to 4800 ml/m$^2$, more preferably from 800 to 2400 ml/m$^2$ and especially about 1600 ml/m$^2$ of material processed.

The overflow from the dev/amp tank can be passed straight back into the top of the replenisher tank. It is noted that this is also possible for conventional non-RX development and so is a new feature for both types of development. Preferably the reservoir has means to inhibit mixing of the solution returned from the small volume tank with the unused replenisher solution already in the reservoir. Such means can comprise one or more baffles with moveable members. Baffles looking and operating like horizontal Venetian blinds can be used. This is particularly effective if used with "tall" replenisher tanks. The concentrates A, B, C and D are added batchwise to the replenisher tank at the end of a cycle when the original replenisher has been about 80% used. The concentrates may be mixed in by repeatedly swivelling the venetian blinds from open to closed. Other mixing means could also be used, for example stirrers, paddles or pumps.

The present replenishment system could be used in conjunction with a feedback process control system which would provide sensitometric information to confirm or not, that replenishment was proceeding correctly and make any adjustments if necessary.

The recirculation may be carried out continuously or intermittently. In one method of working the recirculation could be carried out continuously while processing was in progress but not at all or intermittently when the machine was idle.

It is advantageous to use a tank of relatively small volume, for example, a volume of 0.5 to 6 liters. In a preferred embodiment of the present invention the ratio of tank volume to maximum area of material accomodatable therein (ie maximum path length×width of material) is less than 11 dm$^3$/m$^2$, preferably less than 3 dm$^3$/m$^2$. Typically a minilab LVTT has a volume in the range 500 ml to 6 liters whereas a conventional tank has a volume of 15 to 30 liters.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \geqq F/A \leqq 23$$

wherein F is the flow rate of the solution through the nozzle in liters/minute; and A is the cross-sectional area of the nozzle provided in square centimeters.

Providing a nozzle in accordance with the foregoing relationship assures appropriate discharge of the processing solution against the photosensitive material. Such Low Volume Thin Tank (LVTT) systems are described in more detail in the following patent specifications:

U.S. Pat. No. 5,294,956, EP 559,027, U.S. Pat. No. 5,179, 404,
EP 559,025, U.S. Pat. No. 5,270,762, EP 559,026,
WO 92/10790, WO 92/17819, WO 93/04404,
WO 92/17370, WO 91/19226, W0 91/12567
WO 92/07302, WO 93/00612, WO 92/07301, and
WO 92/09932.

The present processing solutions are preferably used in a method of processing carried out by passing the material to be processed through a tank containing the processing solution which is recirculated through the tank at a rate of from 0.1 to 10 tank volumes per minute.

The preferred recirculation rate is from 0.5 to 8, especially from 1 to 6 and particular from 2 to 4 tank volumes per minute.

One form of apparatus that may be used in the present invention is illustrated in FIG. 1 in which Tank (1) holds the relatively large volume of replenisher fitted with "venetian blinds"-type moveable baffles (2) which hinder mixing the returned overflow and the unused replenisher and (3) is the LVTT processing tank of relatively low volume. Inlets for replenisher kits A to D are provided as shown as well as a water inlet (4). In operation the flow rates for the QFR are as shown. At the predetermined times when the contents of Tank (1) are to be replenished, the necessary quantities of Concentrates A–D and water are introduced into (1). At this time the baffles (2) are moved to and fro to mix the contents of the tank (1).

Figure 2:
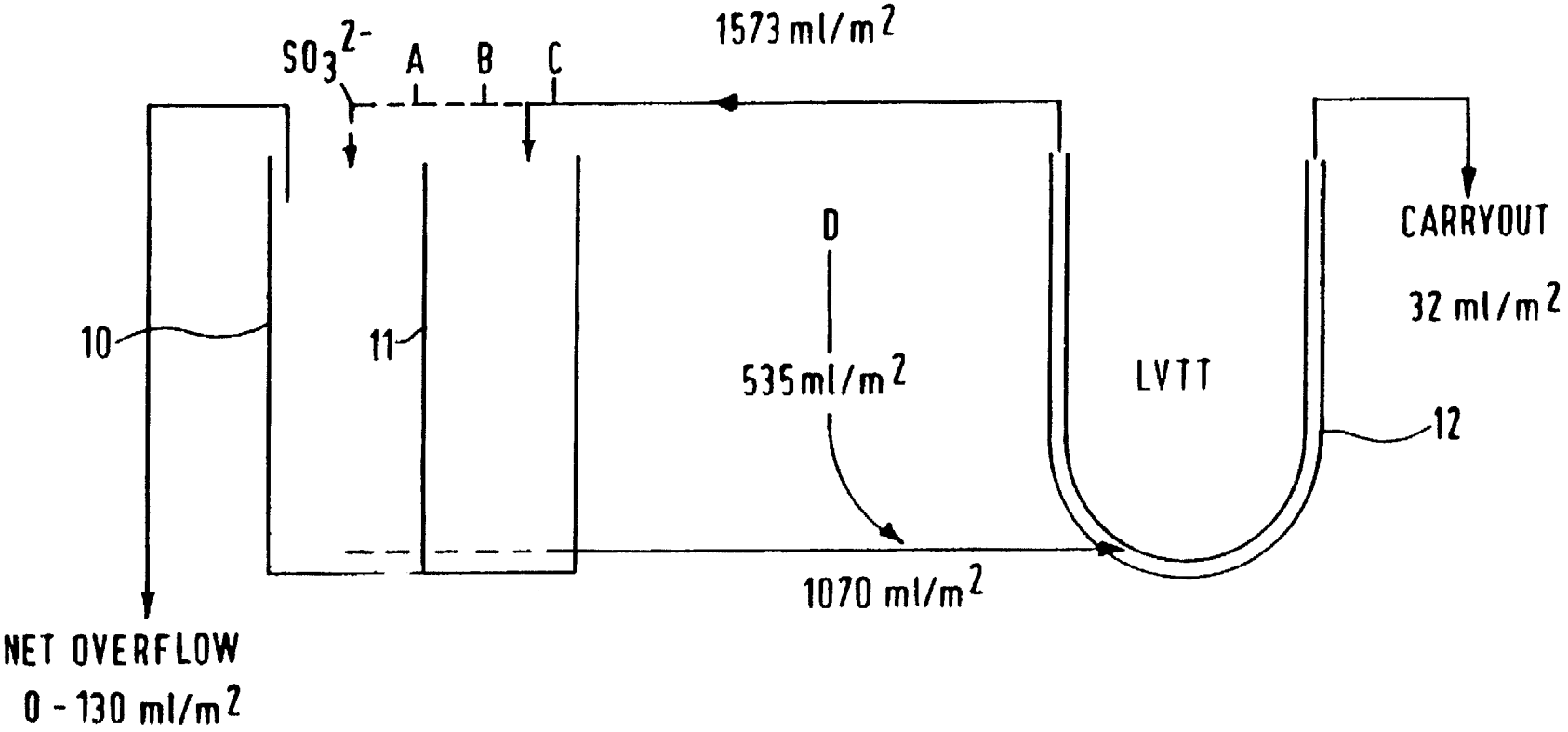

In another form of the invention illustrated in FIG. 2 the replenisher tank (10) has a divider (11) able to separate the two halves in between replenishment cycles. In this embodiment the peroxide replenisher D is mixed in with the replenisher as it is pumped from tank (10) to the processing tank (12). The solution returned from the tank (12) to the left hand side of tank (10) will contain some hydrogen peroxide which is destroyed by the addition of sufficient sulphite ($SO_3^{2-}$). Hence the solution held in the replenisher tank (10) will always be free of peroxide and the addition of D will always be made on that assumption. In this embodiment if would be possible to "stop" the replenisher by destroying oxidant by the addition of sulphite at the end of the working day, the stability of current developer-amplifiers makes it possible to leave them for 48 hours without stopping. Possibly a very small correction to the color developer and oxidant levels at the start of the next day might be advantageous.

A particular application of this technology is in the processing of silver chloride color paper, for example paper comprising at least 85 mole percent silver chloride, especially such paper with low silver levels, for example levels below 30 mg/m$^2$, preferably below 20 mg/m$^2$.

The photographic elements can be single color elements or, preferably, multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements of this invention, reference will be made to Research Disclosure, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

In the Examples below the following color paper was used as the photographic material to be processed.

Silver chloride emulsions were chemically and spectrally sensitized as is described below.

Blue Sensitive Emulsion (prepared similarly to that described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.38 μm in edge length size. This emulsion was optimally sensitized by the addition of a colloidal suspension of aurous sulfide and heat ramped up to 60° C. during which time blue sensitizing dye BSD-1, 1-(3-acetamidophenyl)-5-mercaptotetrazole and potassium bromide were added. In addition, iridium dopant was added during the sensitization process.

Green Sensitive Emulsion: A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. Iridium dopant was added during the late stage of grain formation. The resultant emulsion contained cubic shaped grains of 0.25 μm in edgelength size. This emulsion was optimally sensitized by addition of green sensitizing dye GSD-1, a colloidal suspension of aurous sulfide, heat digestion followed by the addition of 1-(3-acetamidophenyl)-5-mercaptotetrazole and potassium bromide.

Red Sensitive Emulsion: A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.29 μm in edgelength size. This emulsion was optimally sensitized by the addition of a colloidal suspension of aurous sulfide followed by a heat ramp, and further additions of 1-(3-acetamidophenyl)-5-mercapto-tetrazole, potassium bromide and red sensitizing dye RSD-1, and supersensitizer SS-1. In addition, iridium dopant was added during the sensitization process.

Coupler dispersions were emulsified by methods well known to the art, and the following layers were coated on a polyethlene resin coated paper support, that was sized as described in U.S. Pat. No. 4,994,147 and pH adjusted as described in U.S. Pat. 4,917,994. The polyethylene layer coated on the emulsion side of the support contained a mixture of 0.1% (4,4'-bis(5-methyl-2-benzoxazolyl) stilbene and 4,4"-bis(2-benzoxazolyl) stilbene, 12.5% $TiO_2$, and 3% ZnO white pigment. The layers were hardened with bis (vinylsulfonyl methyl) ether at 1.95% of the total gelatin weight.

| | |
|---|---|
| Layer 1: Blue Sensitive Layer | |
| Gelatin | 1.525 g/m² |
| Blue Sensitive Silver (0.38 μm grain edge length) | 0.025 g Ag/m² |
| Y-1 | 0.915 g/m² |
| ST-1 | 0.265 g/m² |
| Tris(2-ethylhexyl)phosphate | 0.878 g/m² |
| 2-(2-butoxyethoxy)ethyl acetate | 0.229 g/m² |
| Phenylmercaptotetrazole | 0.0003 g/m² |
| KCl | 0.0075 g/m² |
| DYE-1 | 0.001 g/m² |
| Layer 2: Interlayer | |
| Gelatin | 0.973 g/m² |
| Dioctyl hydroquinone | 0.121 g/m² |
| Dibutyl phthalate | 0.282 g/m² |
| Disodium 4,5 Dihydroxy-m-benzenedisulfonate | 0.065 g/m² |
| Alkanol ™ XC | 0.0019 g/m² |
| Layer 3: Green Sensitive Layer | |
| Gelatin | 1.065 g/m² |
| Green Sensitive Silver (0.25 μm grain edge length) | 0.018 g Ag/m² |
| M-1 | 0.329 g/m² |
| Dibutyl phthalate | 0.847 g/m² |
| ST-2 | 0.166 g/m² |
| Dioctyl hydroquinone | 0.039 g/m² |
| Phenylmercaptotetrazole | 0.0001 g/m² |
| KCl | 0.020 g/m² |
| DYE-2 | 0.007 g/m² |
| Layer 4: UV Interlayer | |
| Gelatin | 0.484 g/m² |
| UV-1 | 0.028 g/m² |
| UV-2 | 0.159 g/m² |
| Dioctyl hydroquinone | 0.038 g/m² |
| 1,4-Cyclohexylenedimethylene bis(2-ethylhexanoate) | 0.062 g/m² |
| Layer 5: Red Sensitive Layer | |
| Gelatin | 1.212 g/m² |
| Red Sensitive Silver (0.29 μm grain edge length) | 0.016 g Ag/m² |
| C-1 | 0.360 g/m² |
| Dibutyl phthalate | 0.414 g/m² |
| UV-1 | 0.232 g/m² |
| 2-(2-butoxyethoxy)ethyl acetate | 0.035 g/m² |
| Dioctyl hydroquinone | 0.003 g/m² |

-continued

| | |
|---|---|
| Potassium tolylthiosulfonate | 0.8 mg/m$^2$ |
| Potassium tolylsulfinate | 0.08 mg/m$^2$ |
| KCl | 0.007 g/m$^2$ |
| DYE-3 | 0.018 g/m$^2$ |
| Layer 6: UV Overcoat | |
| Gelatin | 0.484 g/m$^2$ |
| UV-1 | 0.028 g/m$^2$ |
| UV-2 | 0.159 g/m$^2$ |
| Dioctyl hydroquinone | 0.038 g/m$^2$ |
| 1,4-Cyclohexylenedimethylene bis(2-ethylhexanoate) | 0.062 g/m$^2$ |
| Layer 7: SOC | |
| Gelatin | 1.076 g/m$^2$ |
| Polydimethylsiloxane | 0.027 g/m$^2$ |
| SF-1 | 0.009 g/m$^2$ |
| SF-2 | 0.004 g/m$^2$ |
| Tergitol ™ 15-S-5 | 0.003 g/m$^2$ |

Structures

BSD-1

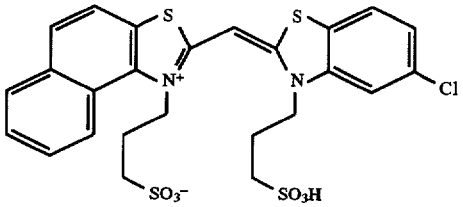

GSD-1

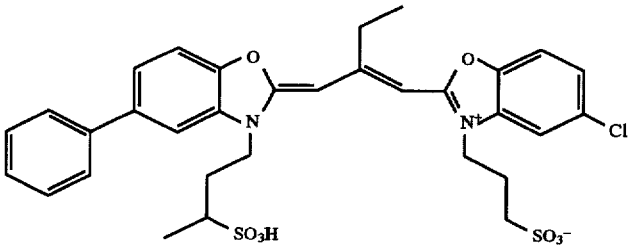

RSD-1

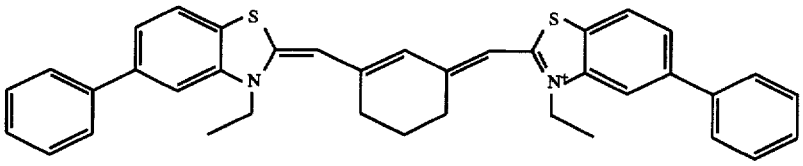

SS-1

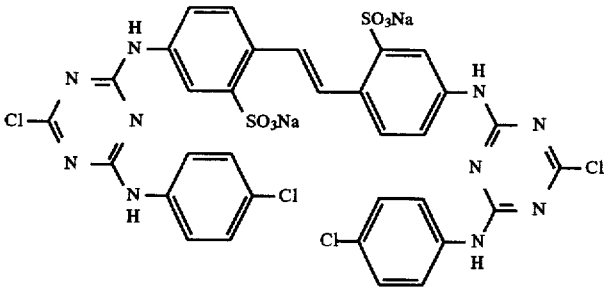

-continued
Y-1
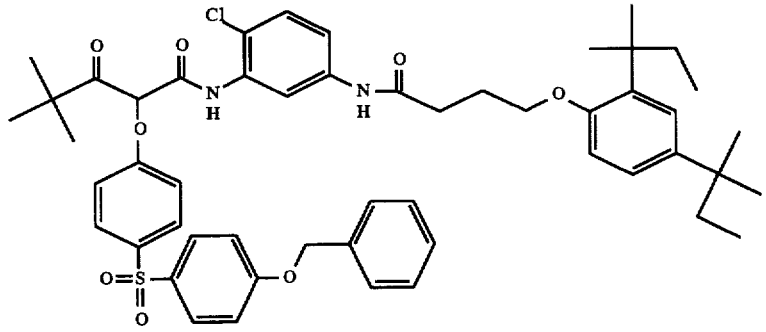
M-1
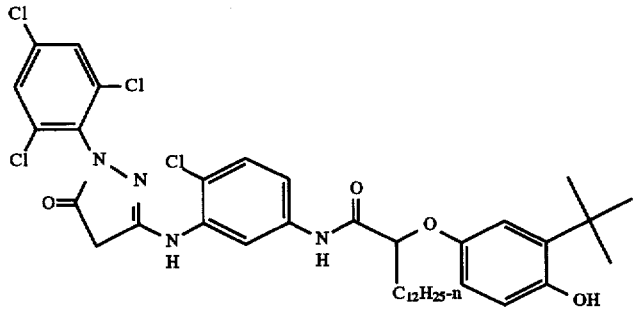
C-1
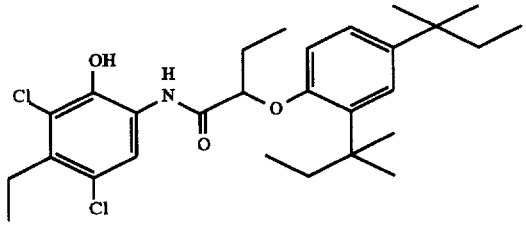
ST-1
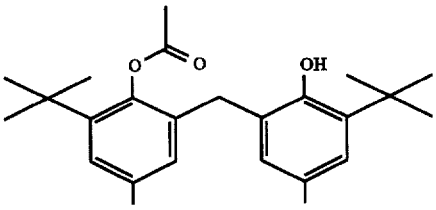
ST-2
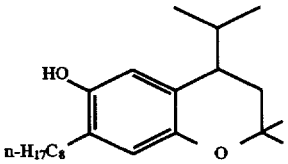
DYE-1
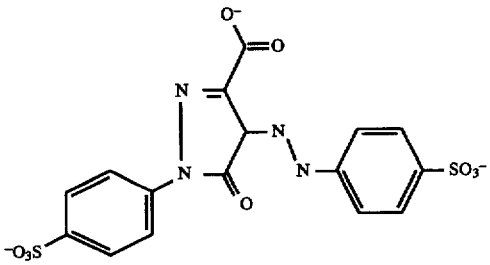

-continued

DYE-2

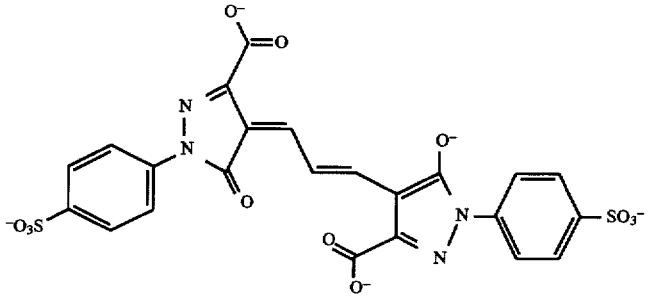

DYE-3

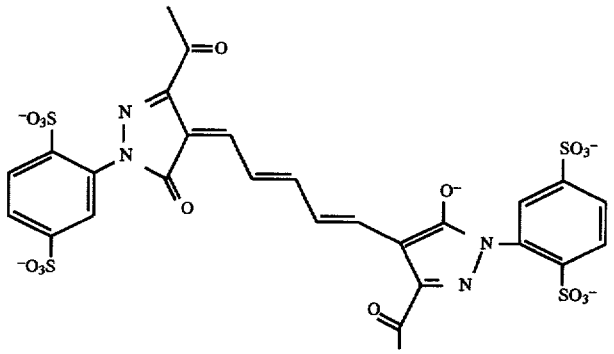

UV-1

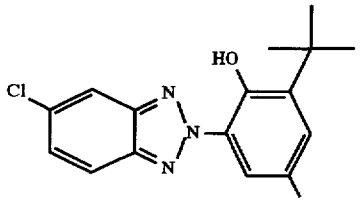

UV-2

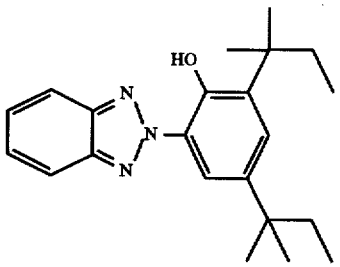

SF-1

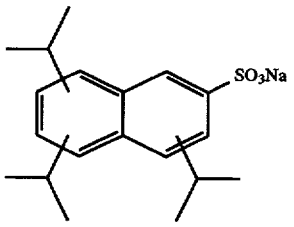

$CF_3-(CF_2)_7-SO_3Na$ SF-2

The following Examples are included for a better understanding of the invention.

EXAMPLE 1

The scheme outlined in FIG. 1 shows one version of the invention in which the replenisher is added at about 10 times the normal rate or about 1573 ml/m$^2$ for a paper process. The overflow is passed back into the top of the replenisher tank which has baffles to minimise mixing of replenisher and overflow. The flooded replenisher passes out of the bottom of the replenisher tank. After a prescribed cycle time, eg half a day, the replenisher tank is "replenished" by water and solution from four kit concentrates A–D whose compositions are given below.

The "net" replenishment rate is 48.5 ml/m$^2$ for the concentrates shown above without any water addition. These concentrates could be made more "concentrated" and a separate addition of water made to make-up the total volume added to 48.5 ml/m$^2$. The "net" replenishment rate could also be higher or lower than this and the concentration of the concentrates would be adjusted as appropriate. The minimum "net" replenishment rate is about 27 to 32 ml/m$^2$ which is equal to carryout plus evaporation, consistent with maintaining the overall volume of the system.

After this replenishment, called "replenishment-proper", mixing of the replenished components with the tank contents is necessary and this could be achieved with stirrers or paddles or pumps or by movement of "Venetian Blind" baffles if present. Unlike a normal replenishment system for a redox system where the peroxide and the developer replenishers are separate, the one in FIG. 1 has peroxide already mixed into the developer-replenisher. This is possible because the stability now achievable is such that only a small chemical change occurs during a working day.

In one embodiment the peroxide can be removed at the end of the day by addition of sulphite. In another there is no sulphite addition but there would be an adjustment made at the beginning of the next working day. In a third embodiment the tank of comparatively small volume is fed with separate developer and oxidant replenishers.

The reason why the overflow from the developer tank can be passed back into the top of the replenisher tank is that the difference in composition between the two solutions is small, as shown in Table 1. This means that it is easy to maintain accurate flooded replenishment using a cheap bellows pump. Another advantage of the system is that the flooded replenisher is much more dilute than one used at the normal rate and is therefore easier to make up with less risk of precipitation and discoloration due oxidation of the color developing agent. This also means the flooded system is much easier to adapt to lower net replenishment rates which otherwise would need highly concentrated (made-up) replenishers of dubious practicality.

TABLE 1

Developer/amplifier and Replenisher Composition (Component amounts per liter)

| Component | Developer/ amplifier | Dev/amp Replenisher |
|---|---|---|
| AC5 | 0.6 g | 0.6 g |
| DTPA | 0.81 g | 0.81 g |
| $K_2HPO_4.3H_2O$ | 40 g | 40 g |
| KBr | 1 mg | 0.9 mg |
| KCl | 0.5 g | 0.45 g |
| CDS | 0.3 g | 0.3 g |
| Hydroxylamine sulphate | 1.0 g | 1.2 g |
| 4-N-ethyl-N-(β-methanesulphonamido-ethyl)-o-toluidine sesquisulphate (CD3) | 4.5 g | 4.7 g |
| Tween ™ 80 | 0.8 g | 0.8 g |
| Dodecylamine | 0.1 g | 0.1 g |
| pH | 11.4 | 11.55 |
| $H_2O_2$ (30%) | 2.0 ml | 2.2 ml |

AC5 is 1-hydroxy-ethylidene-1,1-diphosphonic acid. DTPA diethylene triamine penta acetic acid, CDS is catechol disulphonate, and HAS is hydroxylamine sulphate.

| | |
|---|---|
| **Concentrate A - used at 11 mlm$^2$ of paper.** | |
| Demineralized water | 500 ml |
| AC5 | 2.7 ml |
| DTPA | 3.65 g |
| $K_2HPO_4.3H_2O$ | 180 g |
| KOH (solid) | 112 g |
| Demineralized water to 1 liter. | |
| **Concentrate B - used at 11 ml/m$^2$ of paper.** | |
| Demineralized water | 800 ml |
| HAS | 14.14 g |
| Demineralized water to 1 liter. | |
| **Concentrate C - used at 11 ml/m$^2$ of paper.** | |
| Demineralized water | 800 ml |
| $K_2$ $SO_3$ (anhydrous) | 0.33 g |
| CD3 | 58.9 g |
| CDS | 1.4 g |
| **Concentrate D used at 16 ml/m$^2$ of paper.** | |
| Demineralized water | 500 ml |
| Tween ™ 80 | 2.4 g |
| Dodecylamine (10%) | 10 g |
| $H_2O_2$ (30%) | 22.14 ml |
| Demineralized water to 1 liter. | |

Where dodecylamine(10%) is a 10% solution of dodecylamine plus an equimolar quantity of glacial acetic acid in water.

The dev/amp-replenisher is contained in the reservoir in FIG. 1 and the developer/amplifier in the LVTT. It can be seen from Table 1 that there is only a small difference between the Developer/amplifier and Developer/amplifier Replenisher in terms of the active components such as KCl, KBr, CD3, HAS, pH and $H_2O_2$. This difference is however precisely calculated to maintain the correct developer composition at the increased rate of addition. Other inactive components which are not consumed or liberated by the process such as AC5 and DTPA essentially season-in to the same level as in the Developer Replenisher. This composition is balanced for about 1614 ml/m$^2$ or about 10× the normal replenishment rate. If the flooded rate were increased to 3228 ml/m$^2$ the difference between the developer and developer-replenisher concentrations for components that are consumed or liberated such as CD3, peroxide, pH, HAS and chloride would be halved.

After a prescribed cycle time or replenisher volume has been added (which is estimated to be at least half the replenisher reservoir volume) the replenishment-proper is carried out using kit concentrates A, B and C and peroxide (D) directly into the replenisher tank. This is done in retrospect after the paper has been processed and so should be extremely accurate. The accuracy comes from knowing exactly how much paper has been processed, potential density information from this paper and the integrating effect of a relatively large number of prints which should be close to the overall average density. In addition the concentrates A, B, C and D are added as the cumulative volume in four shots (A, then B, then C, then D) of relatively large size. This avoids the usual problem with direct-replenishment (Drep) which requires a continuous or continual flow of very small volumes. This also applies to additions of water.

At the same time as replenishing for chemicals used by the paper, time dependent replenishment(TDR) can also be carried out. The primary use of TDR would however be for low utilisation conditions where the standard replenishment with concentrates just for paper usage would not be sufficient to account for additional chemical losses due to aerial oxidation and component interactions. In addition if there were any degradation of the made-up replenisher overnight it could be compensated for by TDR the next day. A simple calculation can allow for these losses and this correction is best done by adding extra amounts of parts A, B, C and D at the start of the day.

EXAMPLE 2

The following solutions were used in this example.

TABLE 2

Normal and QFR "made-up" RX Replenishers

| Component | Normal "made-up" Rep | QFR "made-up" Rep |
|---|---|---|
| AC5 | 0.6 g/l | 0.6 g/l |
| DTPA | 0.81 g/l | 0.81 g/l |
| $K_2HPO_4.3H_2O$ | 40 g/l | 40 g/l |
| KBr | 0 | 0.9 mg/l |
| KCl | 0 | 0.45 g/l |
| CDS | 0.3 g/l | 0.3 g/l |
| KOH (50%) | 15 ml/l | 10 ml/l |
| HAS | 2.3 g/l | 1.15 g/l |
| CD3 | 6.8 g/l | 4.7 g/l |
| Tween 80 ™ | 0.8 g/l | 0.8 g/l |
| Dodecylamine | 0.1 g/l | 0.1 g/l |
| pH | 11.85 | 11.55 |
| $H_2O_2$ (30%) | 3.25 ml/l | 2.15 ml/l |
| Rate | 15 ml/sq. ft | 150 ml/sq. ft |

The composition of the developer/amplifier that these replenishers are designed to maintain is the same for both systems and is shown in Table 3 below.

TABLE 3

Developer/amplifier Composition

| Component | Concentration |
|---|---|
| AC5 | 0.6 g/l |
| DTPA | 0.81 g/l |
| $K_2HPO_4.3H_2O$ | 40 g/l |
| KBr | 1 mg/l |
| KCl | 0.5 g/l |
| CDS | 0.3 g/l |
| KOH (50%) | 10 ml/l |
| HAS | 1.0 g/l |
| CD3 | 4.5 g/l |
| Tween 80 ™ | 0.8 g/l |
| Dodecylamine | 0.1 g/l |
| pH | 11.4 |
| $H_2O_2$ (30%) | 2.0 ml/l |

The difference in concentration between the two replenishers means that the QFR version is much more stable than a "made-up" replenisher used at the normal addition rate. This is illustrated by the data shown in Table 4.

TABLE 4

Chemical Loss Rates of "made-up" Replenishers

| Age (days) | pH | $H_2O_2$ (ml/l) | HAS (g/l) | CD3 (g/l) |
|---|---|---|---|---|
| Normal "made-up" Replenisher | | | | |
| 0 | 11.78 | 3.26 | 2.30 | 7.0 |
| 1 | 11.75 | 3.09 | 2.10 | 6.6 |
| 2 | 11.63 | 2.93 | 2.02 | 5.8 |
| 3 | 11.62 | 2.83 | 1.94 | 6.0 |
| 4 | 11.52 | 2.77 | 1.75 | 5.7 |
| 6 | 11.33 | 2.52 | 1.44 | — |

TABLE 4-continued

Chemical Loss Rates of "made-up" Replenishers

| Age (days) | pH | $H_2O_2$ (ml/l) | HAS (g/l) | CD3 (g/l) |
|---|---|---|---|---|
| 7 | 11.31 | 2.56 | 1.29 | 5.1 |
| 8 | 11.20 | 2.32 | 1.07 | 4.8 |
| 9 | 11.11 | 2.19 | 0.87 | 4.7 |
| QFR "made-up" Rep | | | | |
| 0 | 11.45 | 2.15 | 1.14 | 4.7 |
| 1 | 11.43 | 2.08 | 1.08 | 4.4 |
| 2 | 11.42 | 1.89 | 1.00 | 5.2 |
| 3 | 11.35 | 1.91 | 0.97 | 4.2 |
| 4 | 11.25 | 1.86 | 0.88 | 4.0 |
| 6 | 11.08 | 1.79 | 0.72 | — |
| 7 | 11.05 | 1.81 | 0.61 | 3.8 |
| 8 | 10.92 | 1.61 | 0.53 | 3.7 |
| 9 | 10.87 | 1.60 | 0.40 | 3.6 |

If these replenishers are used to replenish a working developer tank their effectiveness will depend on the age of the replenisher. If the replenishers are 7 days old and are used to replenish a developer for three tank turnovers(TTOs) the developer compositions shown in Table 5 are obtained in terms of the components analysed. The other developer components are stable and are not any different in the two systems.

TABLE 5

Developer/amplifier Composition after 3TTO

| Component | Using Normal Rep | Using QFR Rep |
|---|---|---|
| HAS | 0 (1.0) | 0.48 (1.0) |
| CD3 | 2.78 (4.5) | 3.57 (4.5) |
| $H_2O_2$ | 1.36 (2.0) | 1.69 (2.0) |
| pH | 10.86 (11.40) | 10.95 (11.40) |

The numbers in brackets are the aim levels of these components in the developer solution and these are the same for both replenishment systems.

It can be seen for the normally replenished system that HAS is zero after 3TTO and this developer would collapse from this point on. The QFR replenished system still retains half the initial HAS. In fact the concentration fall for all the components except pH in the normally replenished system is about twice that in the QFR replenished system.

The sensitometric consequences of these changes in developer composition are shown in Table 6. Here the developers replenished with 7 day old "normal" made-up RX replenisher(N_RX) and with 7 day old QFR replenisher (QFR_RX) are compared with each other and with a fresh developer.

TABLE 6

Developer/amplifier Comparison

| | Fresh Developer | | | N_RX | | | QFR_RX | | |
|---|---|---|---|---|---|---|---|---|---|
| | R | G | B | R | G | B | R | G | B |
| Dmax | 251 | 230 | 219 | 234 | 199 | 182 | 260 | 216 | 205 |
| Dmin | 009 | 010 | 009 | 010 | 011 | 009 | 010 | 011 | 009 |
| Sens | 130 | 118 | 126 | 122 | 105 | 116 | 132 | 117 | 124 |

TABLE 6-continued

| | Developer/amplifier Comparison | | | | | | | | |
|---|---|---|---|---|---|---|---|---|---|
| | Fresh Developer | | | N_RX | | | QFR_RX | | |
| | R | G | B | R | G | B | R | G | B |
| | After 24 hours | | | | | | | | |
| Dmax | 204 | 194 | 189 | 179 | 149 | 165 | 228 | 193 | 187 |
| Dmin | 010 | 011 | 009 | 010 | 011 | 009 | 011 | 011 | 009 |
| Sens | 124 | 112 | 110 | 119 | 97 | 112 | 128 | 111 | 119 |
| | After 89 hours | | | | | | | | |
| Dmax | 213 | 195 | 182 | 64 | 58 | 73 | 189 | 172 | 177 |
| Dmin | 010 | 011 | 010 | 010 | 011 | 009 | 011 | 011 | 010 |
| Sens | 125 | 113 | 119 | — | — | — | 118 | 103 | 113 |

Where Dmax is maximum density×100, Dmin is minimum density×100 and Sens is the relative sensitivity.

It can be seen that QFR_RX is closer in initial sensitometry to the fresh developer than N_RX. In addition if the developers are left standing unused for 24 hours QFR_RX is still very close to the fresh developer whereas N_RX has lost Dmax and sens. After a further weekend standing unused N_RX has collapsed whereas QFR is still quite close to the fresh developer. This clearly demonstrates the advantage of QFR in using made-up RX replenishers.

EXAMPLE 3

Separate Developer and Peroxide Replenishers

In this example a quasi-flooded or partially quasi-flooded system is outlined which uses separate developer-replenisher and peroxide. This is shown in FIG. 2. Here the overall replenishment rate is 1614 ml/m$^2$ or about 10× the standard rate with developer replenisher at 1076 ml/m$^2$ and peroxide at 538 ml/m$^2$. The overflow passes from the LVTT to the second replenisher tank where peroxide is removed with sulphite. The developer, the developer replenisher and the Peroxide-Replenisher are shown in Table 7.

TABLE 7

| Dev/amp, Dev/amp Replenisher and Peroxide Replenisher Composition (Component amounts per liter) | | | |
|---|---|---|---|
| Component | Developer/ amplifier | Dev/amp Replenisher | Peroxide Replenisher |
| AC5 | 0.6 g | 0.9 g | |
| Diethyltriamine-pentaacetic acid | 2.0 ml | 3.0 ml | |
| $K_2HPO_4.3H_2O$ | 40 g | 60 g | |
| KBr | 1 mg | 1.35 mg | |
| KCl | 0.5 g | 0.675 g | |
| CDS | 0.3 g | 0.45 g | |
| HAS | 1.0 g | 1.8 g | |
| CD3 | 3.5 g | 5.7 g | |
| pH | 11.0 | 11.3 | |
| $H_2O_2$ (30%) | 2.0 ml | | 6.6 ml |

In FIG. 2 the developer-replenisher is contained in one side of the divided REP.TANK, the developer is in the LVTT and the peroxide-replenisher is in a separate container. The developer-overflow from the LVTT passes into the other side of the divided REP.TANK in FIG. 2 where peroxide is removed by sulphite addition and the appropriate amounts of A, B and C concentrates are added. The developer-replenisher and peroxide-replenisher can pumped together or separately into the LVTT working tank. After a prescribed cycle time the collected overflow is replenished with concentrates and this is then used as the replenisher source for the next cycle and overflow collected in the other replenisher tank. The cross-over between tanks is arranged by having level sensors in the tank, one to detect when they are full and one when they are almost empty.

I claim:

1. A method of redox amplification processing of a photographic color material in which the image-forming step takes place in a developer-amplifier solution containing both a photographic color developing agent and an oxidant contained in a processing tank of comparatively small volume (the processing tank), in which a developer-amplifier replenisher solution which is stable over an idle period of 48 hours, is provided from a tank of comparatively large volume (the reservoir) holding sufficient for replenishment over a predetermined extended period of time at a rate which is greater than 160 ml/m$^2$ of material processed, the overflow from the processing tank is returned to the reservoir where additions are made in a predetermined manner from water and/or one or more of four solutions comprising color developing agent concentrate, oxidant concentrate, buffer concentrate and anti-oxidant concentrate.

2. A method according to claim 1 in which the replenishment rate is from 320 to 4800 ml/m$^2$ of material processed.

3. A method according to claim 1 in which the processing tank of comparatively small volume has a volume in the range 0.5 to 6 liters.

4. A method according to claim 1 in which processing solution is recirculated from the large volume tank to the small volume tank and back continuously or intermittently.

5. A method according to claim 1 in which means are provided in the reservoir which inhibit mixing of the solution returned from the small volume tank with the unused replenisher.

6. A method according to claim 5 in which the means comprises one or more baffles with moveable members.

7. A method according to claim 1 in which the replenisher solution contains hydroxylamine or a salt thereof.

8. A method according to claim 1 in which the replenisher solution contains a compound having a hydrophobic hydrocarbon group and a group which adsorbs to silver or stainless steel solubilised if necesssary with a non-ionic water-soluble surfactant.

9. A method according to claim 1 in which the pH of the replenisher solution is in the range 10.5 to 12.

* * * * *